US006644925B1

(12) United States Patent
Collmar

(10) Patent No.: US 6,644,925 B1
(45) Date of Patent: Nov. 11, 2003

(54) BLADE RACK STRUCTURE FOR A CEILING FAN

(75) Inventor: Teddy Patrick Collmar, Pinetop, AZ (US)

(73) Assignee: Great 2000 Enterprises Inc., Corona, CA (US)

( * ) Notice: Subject to any disclaimer, the term of this patent is extended or adjusted under 35 U.S.C. 154(b) by 0 days.

(21) Appl. No.: 10/214,129

(22) Filed: Aug. 8, 2002

(51) Int. Cl.[7] ..... F04D 29/34

(52) U.S. Cl. ..... 416/210 R; 416/244 R; 416/5

(58) Field of Search ..... 416/210 R, 244 R, 416/211, 5, 210 A

(56) References Cited

U.S. PATENT DOCUMENTS 4,936,751 A * 6/1990 Marshall ..... 416/246

* cited by examiner

*Primary Examiner*—Edward K. Look
*Assistant Examiner*—Kimya N McCoy
(74) *Attorney, Agent, or Firm*—Rosenberg, Klein & Lee

(57) ABSTRACT

A ceiling fan includes a rotatable motor seat, and multiple blade racks. The motor seat is provided with multiple retaining studs and multiple locking screws. Each of the multiple blade racks includes an arcuate mounting plate secured on the motor seat. The mounting plate of each of the multiple blade racks has a first end provided with a retaining hook rested on a respective one of the multiple retaining studs, and has a second end provided with a locking hook locked on a respective one of the multiple locking screws. Thus, the blade racks may be assembled and disassembled easily, conveniently and rapidly.

8 Claims, 6 Drawing Sheets

BLADE RACK STRUCTURE FOR A CEILING FAN

BACKGROUND OF THE INVENTION

1. Field of the Invention

The present invention relates to a blade rack structure for a ceiling fan, and more particularly to a blade rack structure for a ceiling fan, wherein the blade rack structure may be assembled and disassembled easily, conveniently and rapidly.

2. Description of the Related Art

A conventional blade rack structure for a ceiling fan comprises multiple blade racks secured on a motor seat to-rotate therewith. In assembly, the motor seat is formed with multiple screw bores, and each of the blade racks is formed with two through holes each aligning with a respective one of the screw bores of the motor seat, so that each of multiple screws may be in turn extended through a respective one of the through holes of each of the blade racks and screwed into a respective one of the screw bores of the motor seat, thereby fixing each of the blade racks on the motor seat. However, the user has to in turn align each of the through holes of each of the blade racks with the respective screw bore of the motor seat, so that each of the blade racks cannot be assembled on the motor seat easily, conveniently and rapidly, thereby causing inconvenience to the user in assembly and disassembly of the blade racks.

SUMMARY OF THE INVENTION

The present invention has arisen to mitigate and/or obviate the disadvantage of the conventional blade rack structure for a ceiling fan.

The primary objective of the present invention is to provide a blade rack structure for a ceiling fan, wherein the blade rack structure may be assembled and disassembled easily, conveniently and rapidly.

Another objective of the present invention is to provide a blade rack structure for a ceiling fan, wherein each of the multiple blade racks may be mounted on the motor seat easily, conveniently and rapidly, without having to align the mounting plate of each of the multiple blade racks with the motor seat, thereby facilitating the user assembling and disassembling each of the multiple blade racks.

In accordance with the present invention, there is provided a ceiling fan, comprising a rotatable motor seat, and multiple blade racks, wherein:

the motor seat is provided with multiple retaining studs and multiple locking screws; and each of the multiple blade racks includes an arcuate mounting plate secured on the motor seat, the mounting plate of each of the multiple blade racks has a first end provided with a retaining hook rested on a respective one of the multiple retaining studs, and has a second end provided with a locking hook locked on a respective one of the multiple locking screws.

Further benefits and advantages of the present invention will become apparent after a careful reading of the detailed description with appropriate reference to the accompanying drawings.

DETAILED DESCRIPTION OF THE INVENTION

Figure 1:
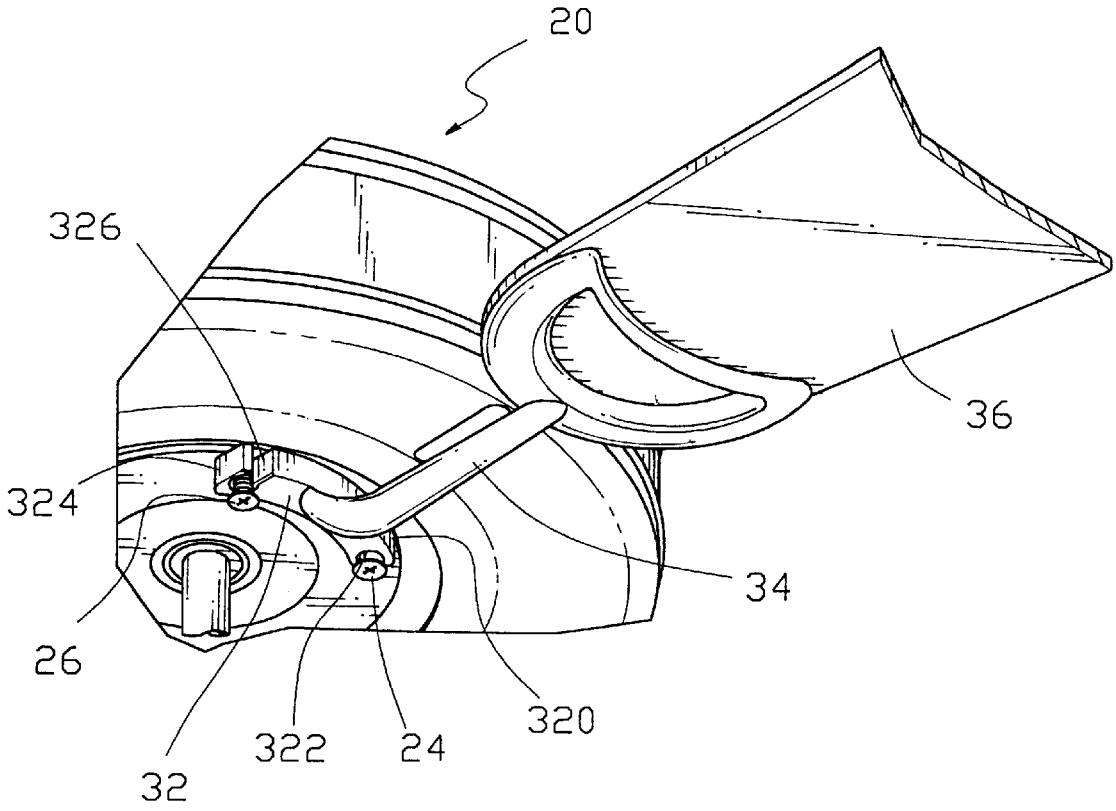
FIG. 1 is a partially cut-away perspective view of a blade rack structure for a ceiling fan in accordance with a preferred embodiment of the present invention.

Referring to the drawings and initially to FIGS. 1–4, a ceiling fan in accordance with a preferred embodiment of the present invention comprises a suspension bell 10, a motor housing 20, and a blade rack structure.

The suspension bell 10 is secured on the ceiling, and is provided with a support rod 12.

The motor housing 20 is secured on the support rod 12, and contains a motor (not shown) therein. A motor seat 22 is rotatably mounted in the motor housing 20, and is rotated by the motor. The motor seat 22 is provided with multiple retaining studs 24 and multiple locking screws 26 each located adjacent to a respective one of the multiple retaining studs 24. Each of the multiple retaining studs 24 is secured on the motor seat 22. Each of the multiple locking screws 26 is rotatably screwed on the motor seat 22.

The blade rack structure includes multiple blade racks 30 each secured on the motor seat 22 to rotate therewith. Each of the multiple blade racks 30 includes an arcuate mounting plate 32 secured on the motor seat 22 to rotate therewith, a support bracket 34 secured on a mediate portion of the mounting plate 32, and a blade 36 secured on a distal end of the support bracket 34.

The mounting plate 32 of each of the multiple blade racks 30 has a first end provided with a retaining hook 320 rested on a respective one of the multiple retaining studs 24, and has a second end provided with a locking hook 324 locked on a respective one of the multiple locking screws 26. The retaining hook 320 of the mounting plate 32 of each of the multiple blade racks 30 is formed with a retaining recess 322 for retaining the respective retaining stud 24. The locking hook 324 of the mounting plate 32 of each of the multiple blade racks 30 is formed with a locking recess 326 for locking the respective locking screw 26. The locking recess 326 of the locking hook 324 of the mounting plate 32 of each of the multiple blade racks 30 has a wall formed with an arcuate receiving groove 328 for receiving the head of the respective locking screw 26.

Figure 2:
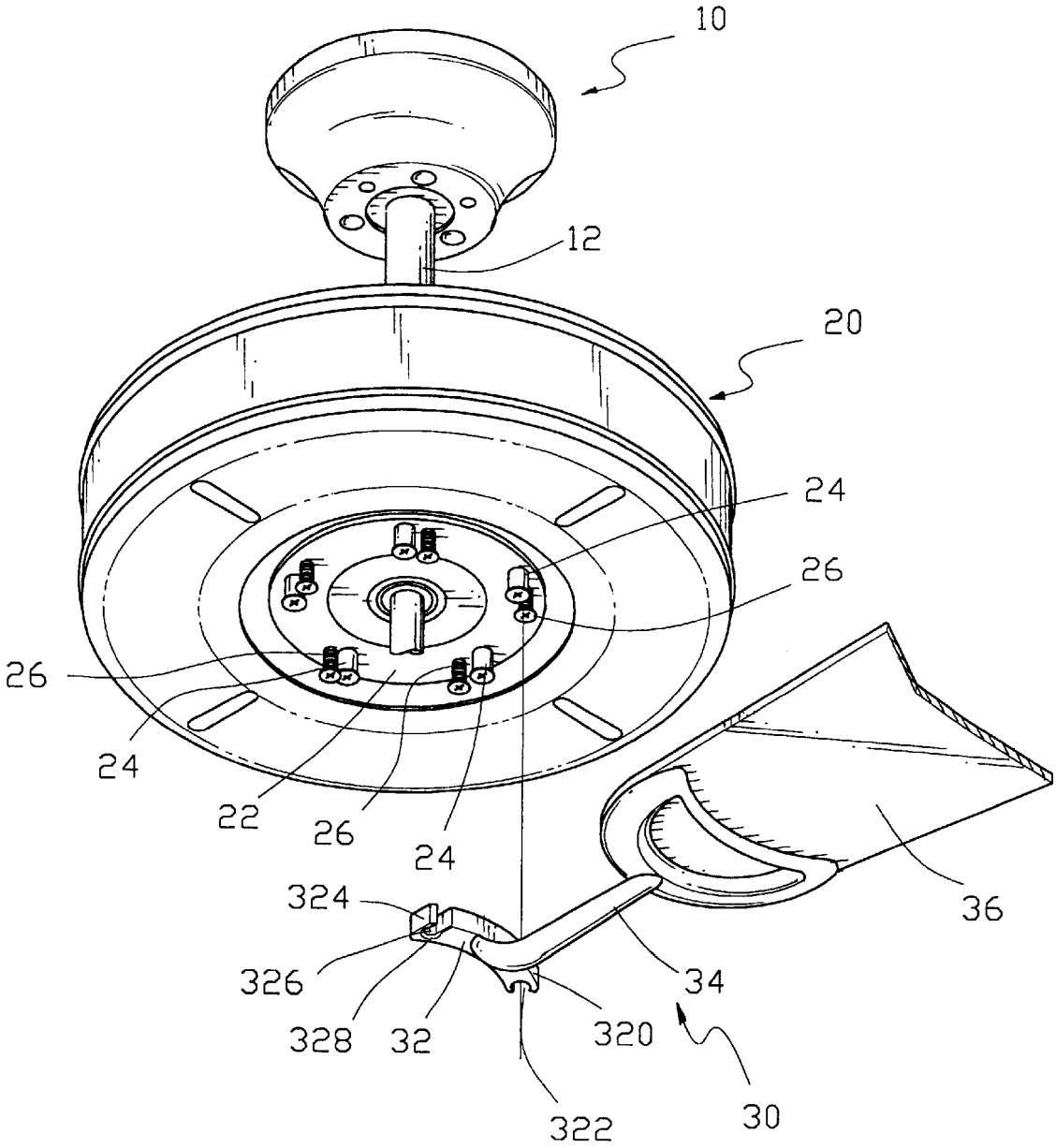
FIG. 2 is an exploded perspective view of the blade rack structure for a ceiling fan in accordance with the preferred embodiment of the present invention.
Figure 3:
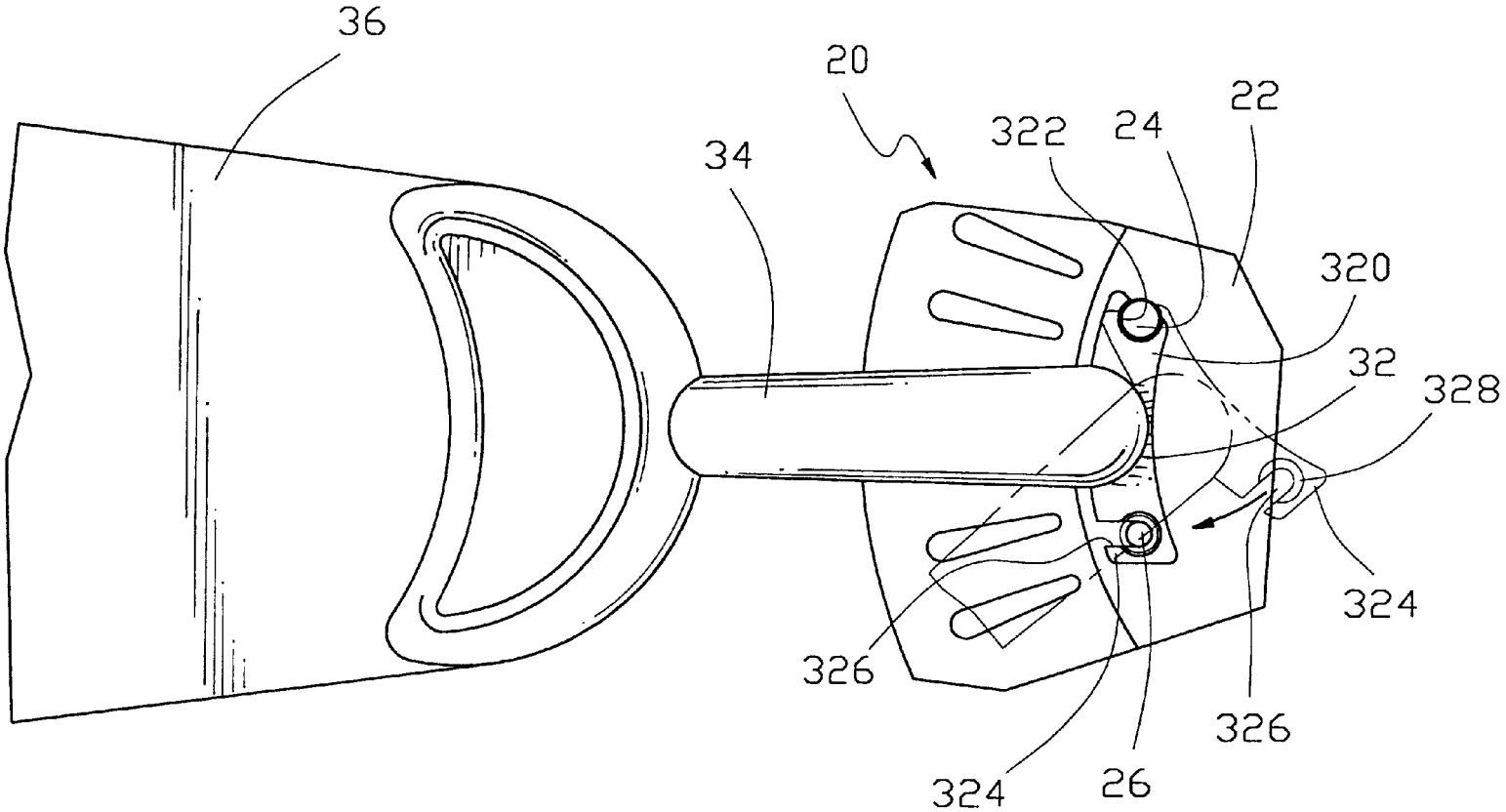
FIG. 3 is a bottom plan operational view of the blade rack structure for a ceiling fan as shown in FIG. 1.
Figure 4:
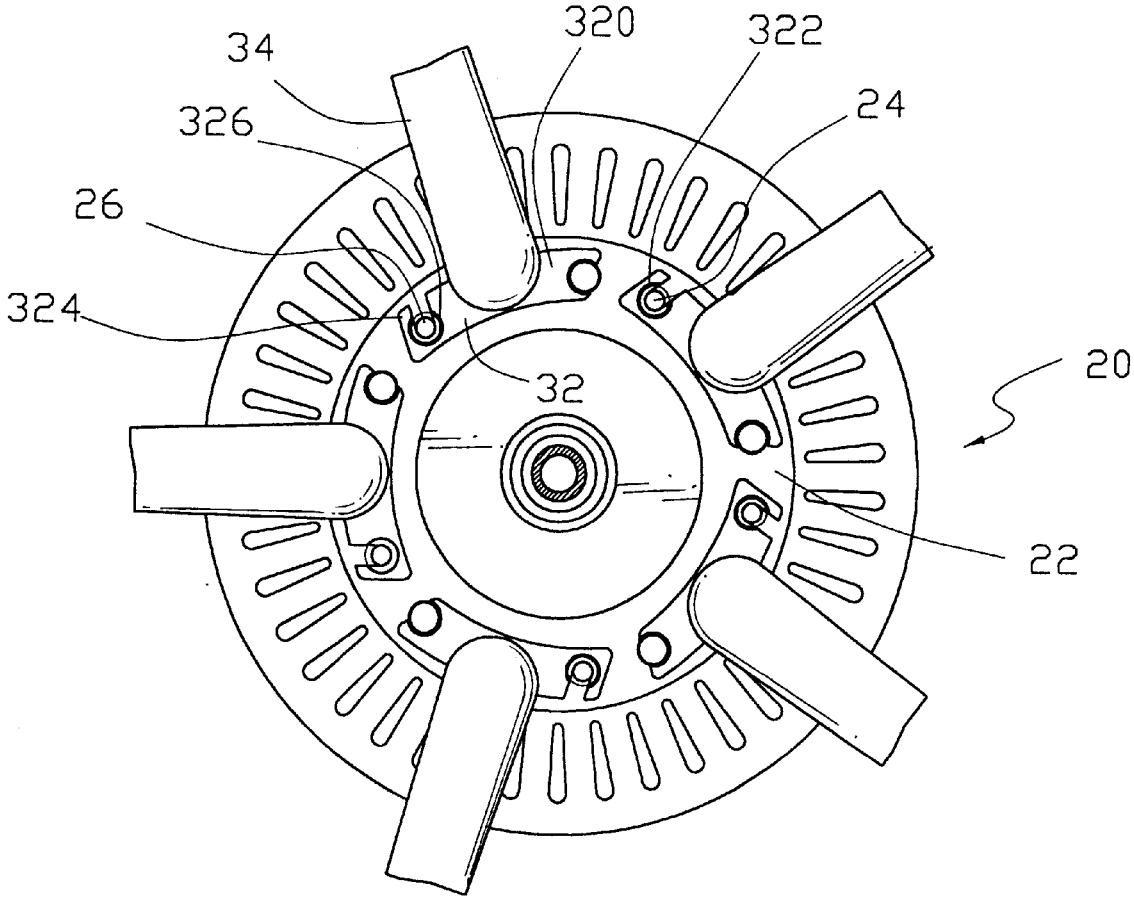
FIG. 4 is a partially cut-away bottom plan view of the blade rack structure for a ceiling fan in accordance with the preferred embodiment of the present invention.

In assembly, referring to FIGS. 3 and 4 with reference to FIGS. 1 and 2, the retaining hook 320 of the mounting plate 32 of each of the multiple blade racks 30 is rested on the respective retaining stud 24 as shown in FIG. 3, with the respective retaining stud 24 being received in the retaining recess 322 of the retaining hook 320.

Then, the mounting plate 32 of each of the multiple blade racks 30 is pivoted about the respective retaining stud 24 to move toward the respective locking screw 26, so that the locking hook 324 of the mounting plate 32 of each of the multiple blade racks 30 may be hooked on the respective locking screw 26 as shown in FIG. 1, with the respective locking screw 26 being received in the locking recess 326 of the locking hook 324.

Then, the respective locking screw 26 may be rotated and screwed into the motor seat 22, so that the locking hook 324 of the mounting plate 32 of each of the multiple blade racks 30 may be locked by the respective locking screw 26 as shown in FIG. 4, thereby fixing the mounting plate 32 of each of the multiple blade racks 30 on the motor seat 22 by the respective locking screw 26.

In such a manner, the user only needs to place the retaining hook 320 of the mounting plate 32 of each of the multiple blade racks 30 on the respective retaining stud 24, and to hook the locking hook 324 of the mounting plate 32 of each of the multiple blade racks 30 on the respective locking screw 26, so as to mount and lock the mounting plate 32 of each of the multiple blade racks 30 on the motor seat 22 by the respective locking screw 26.

Thus, each of the multiple blade racks 30 may be mounted on the motor seat 22 easily, conveniently and rapidly, without having to align the mounting plate 32 of each of the multiple blade racks 30 with the motor seat 22, thereby facilitating the user assembling and disassembling each of the multiple blade racks 30.

Figure 5:
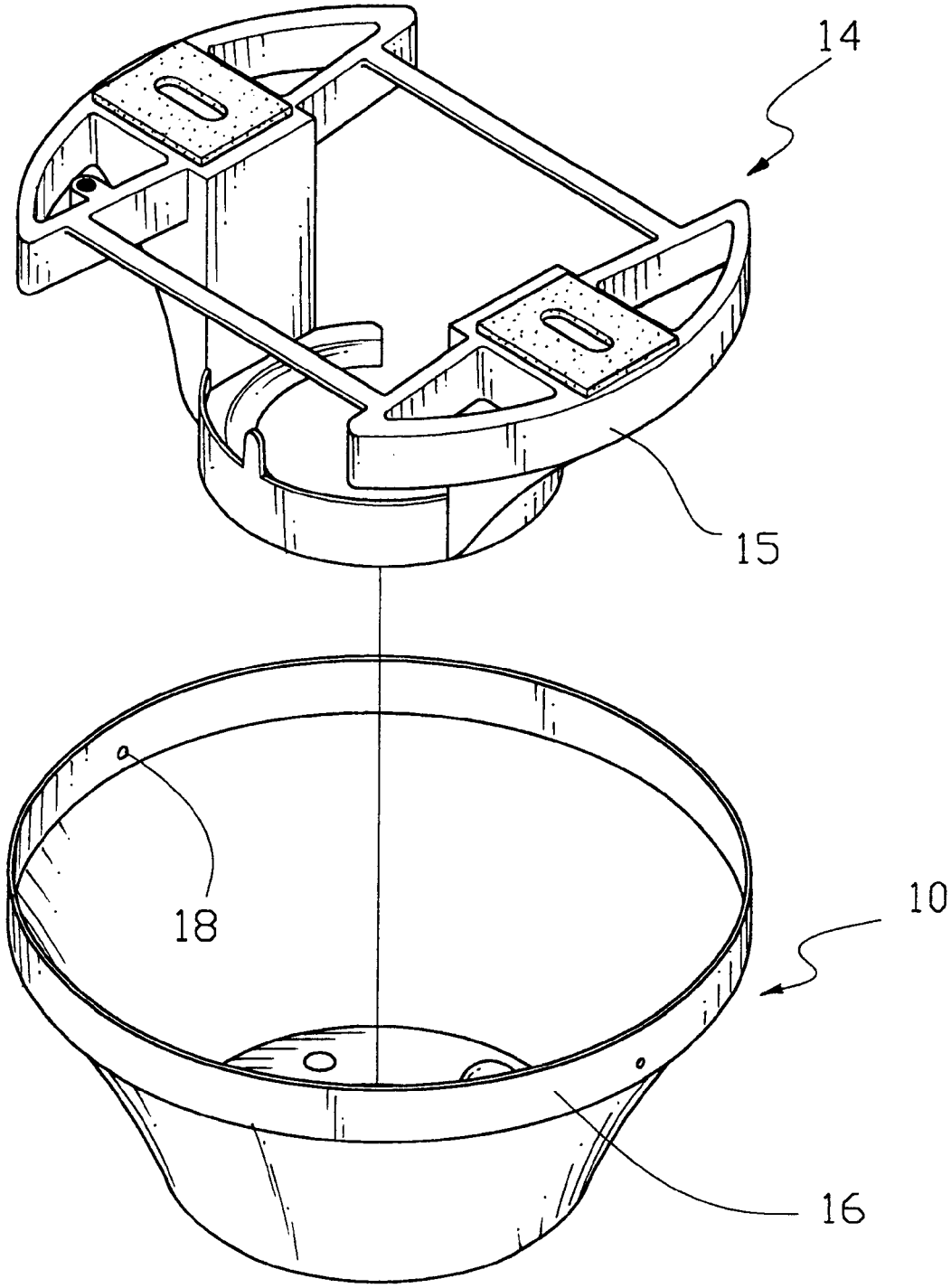
FIG. 5 is an exploded perspective view of the blade rack structure for a ceiling fan in accordance with the preferred embodiment of the present invention.
Figure 6:
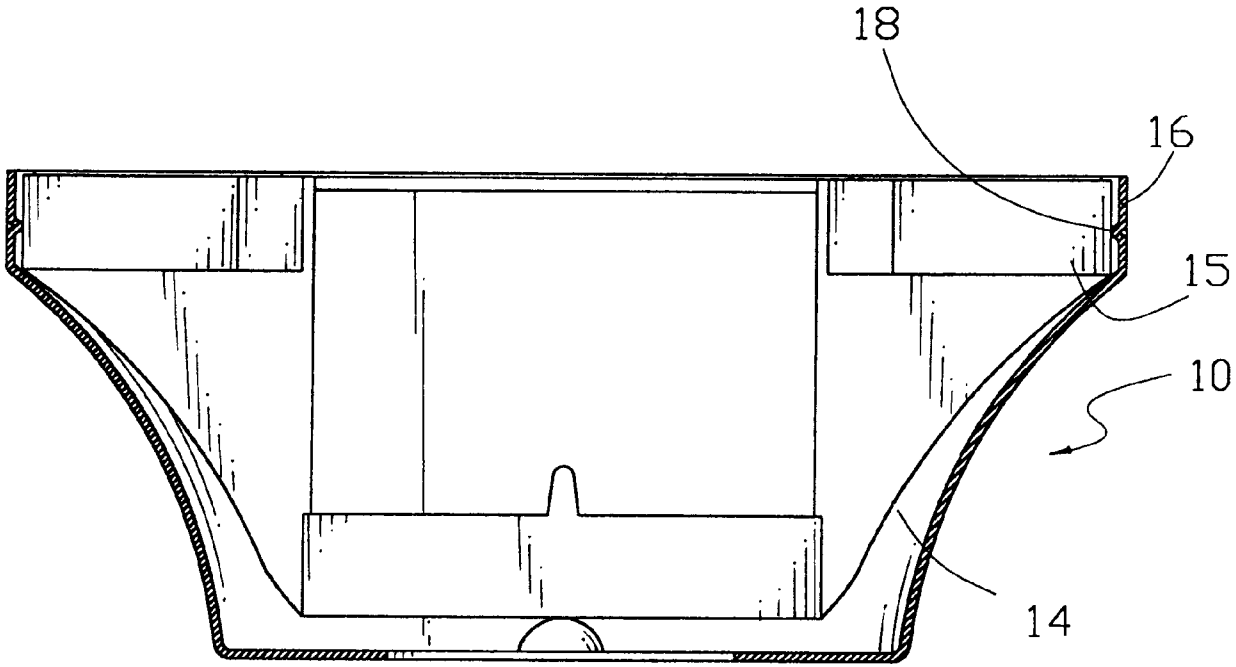
FIG. 6 is a side plan cross-sectional assembly view of the blade rack structure for a ceiling fan as shown in FIG. 5.

Referring to FIGS. 5 and 6, the ceiling fan further comprises a suspension rack 14 secured on the ceiling. The suspension bell 10 is secured on the suspension rack 14. The suspension bell 10 has an annular flange 16 mounted on a periphery 15 of the suspension rack 14. The annular flange 16 of the suspension bell 10 has an inner wall provided with multiple urging bosses 18 urged on the periphery 15 of the suspension rack 14, so that the suspension bell 10 may be secured on the suspension rack 14 in a close fit manner. Thus, the suspension bell 10 may be mounted on the suspension rack 14 easily, conveniently and rapidly, thereby facilitating the user assembling and disassembling the suspension bell 10.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. A ceiling fan, comprising a rotatable motor seat, and multiple blade racks, wherein:

the motor seat is provided with multiple retaining studs and multiple locking screws; and each of the multiple blade racks includes an arcuate mounting plate secured on the motor seat, the mounting plate of each of the multiple blade racks has a first end provided with a retaining hook rested on a respective one of the multiple retaining studs, and has a second end provided with a locking hook locked on a respective one of the multiple locking screws.

2. The ceiling fan in accordance with claim 1, wherein the retaining hook of the mounting plate of each of the multiple blade racks is formed with a retaining recess for retaining the respective retaining stud.

3. The ceiling fan in accordance with claim 1, wherein the locking hook of the mounting plate of each of the multiple blade racks is formed with a locking recess for locking the respective locking screw.

4. The ceiling fan in accordance with claim 3, wherein the locking recess of the locking hook of the mounting plate of each of the multiple blade racks has a wall formed with an arcuate receiving groove for receiving the head of the respective locking screw.

5. The ceiling fan in accordance with claim 1, wherein each of the multiple locking screws is located adjacent to a respective one of the multiple retaining studs.

6. The ceiling fan in accordance with claim 1, wherein each of the multiple retaining studs is secured on the motor seat, and each of the multiple locking screws is rotatably screwed on the motor seat.

7. The ceiling fan in accordance with claim 1, wherein each of the multiple blade racks further includes a support bracket secured on a mediate portion of the mounting plate, and a blade secured on a distal end of the support bracket.

8. The ceiling fan in accordance with claim 1, further comprising a suspension rack secured on a ceiling, and a suspension bell secured on the suspension rack, wherein the suspension bell has an annular flange mounted on a periphery of the suspension rack, and the annular flange of the suspension bell has an inner wall provided with multiple urging bosses urged on the periphery of the suspension rack, so that the suspension bell may be secured on the suspension rack in a close fit manner.

* * * * *